US010429109B2

(12) United States Patent
Onaka et al.

(10) Patent No.: US 10,429,109 B2
(45) Date of Patent: Oct. 1, 2019

(54) REFRIGERANT CIRCUIT AND AIR-CONDITIONING APPARATUS

(71) Applicant: MITSUBISHI ELECTRIC CORPORATION, Chiyoda-ku (JP)

(72) Inventors: Yoji Onaka, Chiyoda-ku (JP); Takashi Matsumoto, Chiyoda-ku (JP); Mizuo Sakai, Chiyoda-ku (JP); Hiroaki Nakamune, Chiyoda-ku (JP); Hiroki Murakami, Chiyoda-ku (JP)

(73) Assignee: MITSUBISHI ELECTRIC CORPORATION, Chiyoda-ku (JP)

( * ) Notice: Subject to any disclaimer, the term of this patent is extended or adjusted under 35 U.S.C. 154(b) by 762 days.

(21) Appl. No.: 14/901,583

(22) PCT Filed: Jun. 27, 2014

(86) PCT No.: PCT/JP2014/067161
§ 371 (c)(1),
(2) Date: Dec. 28, 2015

(87) PCT Pub. No.: WO2015/002086
PCT Pub. Date: Jan. 8, 2015

(65) Prior Publication Data

US 2016/0370042 A1 Dec. 22, 2016

(30) Foreign Application Priority Data

Jul. 2, 2013 (JP) ..... 2013-139102

(51) Int. Cl.

| | |
|---|---|
| ***F25B 43/00*** | (2006.01) |
| ***F25B 5/02*** | (2006.01) |
| ***F25B 40/00*** | (2006.01) |

(52) U.S. Cl.
CPC ..... *F25B 43/00* (2013.01); *F25B 5/02* (2013.01); *F25B 40/00* (2013.01); *F25B 43/006* (2013.01);
(Continued)

(58) Field of Classification Search
CPC . F25B 5/02; F25B 2400/23; F25B 2400/0409
See application file for complete search history.

(56) References Cited

U.S. PATENT DOCUMENTS 3,488,678 A * 1/1970 Wagner ..... F25B 43/006 62/503
4,084,405 A 4/1978 Schibbye et al.
(Continued)

FOREIGN PATENT DOCUMENTS

CN 101000178 A 7/2007
CN 103148625 A 6/2013
(Continued)

OTHER PUBLICATIONS

Extended European Search Report dated Mar. 14, 2017 in European Patent Application No. 14820150.2.
(Continued)

*Primary Examiner* — Orlando E Aviles
(74) *Attorney, Agent, or Firm* — Oblon, McClelland, Maier & Neustadt, L.L.P.

(57) ABSTRACT

A refrigerant circuit includes: plural gas/liquid separators adapted to separate a two-phase gas-liquid refrigerant into refrigerant vapor and refrigerant liquid; a channel switching valve connected upstream of the gas/liquid separators and adapted to switch channels for the two-phase gas-liquid refrigerant by opening and closing; an evaporating heat exchanger adapted to accept inflow of the refrigerant liquid or the two-phase gas-liquid refrigerant, the refrigerant liquid produced by separation by the gas/liquid separators; a
(Continued)

header installed upstream of the evaporating heat exchanger perpendicularly or at angles to the evaporating heat exchanger; a compressor installed downstream of the evaporating heat exchanger; and plural bypass routes connected to the respective gas/liquid separators and adapted to allow passage of the refrigerant vapor. The refrigerant vapor passing through the plural bypass routes and refrigerant vapor passing through the evaporating heat exchanger merge at a first meeting point between the evaporating heat exchanger and the compressor.

11 Claims, 5 Drawing Sheets

(52) U.S. Cl.
CPC . *F25B 2400/0409* (2013.01); *F25B 2400/054* (2013.01); *F25B 2400/12* (2013.01); *F25B 2400/13* (2013.01); *F25B 2400/23* (2013.01); *F25B 2600/2501* (2013.01)

(56) References Cited

U.S. PATENT DOCUMENTS

| | | | | |
|---|---|---|---|---|
| 4,899,555 | A * | 2/1990 | Shaw | F25B 5/04 62/505 |
| 2008/0110200 | A1 | 5/2008 | Javerschek | |
| 2011/0232325 | A1 | 9/2011 | Furui et al. | |

FOREIGN PATENT DOCUMENTS

| | | | |
|---|---|---|---|
| JP | 5-203286 | | 8/1993 |
| JP | 6-109345 | | 4/1994 |
| JP | 8-86519 | | 4/1996 |
| JP | 2000-292016 | A | 10/2000 |
| JP | 2002-206890 | A | 7/2002 |
| JP | 2009-300001 | A | 12/2009 |
| JP | 2011-247473 | A | 12/2011 |
| JP | 2012-193897 | A | 10/2012 |
| WO | 2012/147290 | A1 | 11/2012 |

OTHER PUBLICATIONS

Combined Office Action and Search Report dated Sep. 29, 2016 in Chinese Patent Application No. 201480037859.8 with partial English translation and English translation of categories of cited documents.

International Search Report dated Sep. 16, 2014 in PCT/JP14/67161 Filed Jun. 27, 2014.

* cited by examiner

REFRIGERANT CIRCUIT AND AIR-CONDITIONING APPARATUS

TECHNICAL FIELD

The present invention relates to a refrigerant circuit equipped with a gas/liquid separator as well as to an air-conditioning apparatus.

BACKGROUND ART

In a refrigeration cycle of an air-conditioning apparatus, refrigerant liquid condensed in a condenser is depressurized by an expansion valve and flows into an evaporator in a two-phase gas-liquid state in which refrigerant vapor and refrigerant liquid coexist. When refrigerant flows into the evaporator in two-phase gas-liquid state, in the case of a vertical or inclined header, energy efficiency of the air-conditioning apparatus is decreased due to factors including degraded distribution characteristics with respect to a heat exchanger. Also, due to changes in a flow rate condition such as a high flow rate condition and low flow rate condition, stable distribution characteristics cannot be maintained.

Thus, to improve distribution characteristics, some conventional heat exchangers have a partition installed or a ribbon-shaped turbulence accelerator or a small hole installed in the vertical or inclined header (see, for example, Patent Literature 1).

CITATION LIST

Patent Literature

Patent Literature 1: Japanese Unexamined Patent Application Publication No. 5-203286

SUMMARY OF INVENTION

Technical Problem

However, the vertical or inclined header of the heat exchanger described in Patent Literature 1 does not show much improvement in distribution characteristics with pressure losses occurring at an inlet to the heat exchanger. Also, a structure in the header is complicated, presenting problems such as difficulty of production and increases in costs.

The present invention has been made to solve the above problem and has an object to provide an air-conditioning apparatus and refrigerant circuit that can reduce pressure losses by improving distribution characteristics and curb cost increases.

Solution to Problem

A refrigerant circuit according to the present invention comprises: a plurality of gas/liquid separators adapted to separate a two-phase gas-liquid refrigerant into refrigerant vapor and refrigerant liquid; a channel switching valve connected to an upstream side of the gas/liquid separators and adapted to switch channels for the two-phase gas-liquid refrigerant by opening and closing; an evaporating heat exchanger adapted to accept inflow of the refrigerant liquid or the two-phase gas-liquid refrigerant, the refrigerant liquid being produced as a result of separation by the gas/liquid separators; a header installed on an upstream side of the evaporating heat exchanger perpendicularly or at angles to the evaporating heat exchanger; a compressor installed on a downstream side of the evaporating heat exchanger; and a plurality of bypass routes connected to the respective gas/liquid separators and adapted to allow passage of the refrigerant vapor, the refrigerant vapor passing through the plurality of bypass routes and refrigerant vapor passing through the evaporating heat exchanger merge at a first meeting point between the evaporating heat exchanger and the compressor.

Advantageous Effects of Invention

The refrigerant circuit according to the present invention makes it possible to improve distribution characteristics and reduce pressure losses by adjusting quality (or void fraction) of the two-phase gas-liquid refrigerant flowing into the vertical or inclined header of the heat exchanger. Also, because a structure of the vertical or inclined header is not changed, increases in costs can be curbed. Furthermore, when the refrigerant used is a mildly flammable refrigerant (e.g., R32 refrigerant, HFO refrigerant, or a mixture thereof) or a flammable refrigerant (propane, isobutane, dimethyl ether, or a mixture thereof), volume per gas/liquid separator can be reduced.

DESCRIPTION OF EMBODIMENTS

Embodiments of the present invention will be described hereinafter with reference to the drawings by taking as an example a distribution system equipped with two gas/liquid separators. Note that the present invention is not limited by the embodiments described below. Also, in the following drawings, components may not be shown in their true size relations.

Embodiment 1

Figure 1:
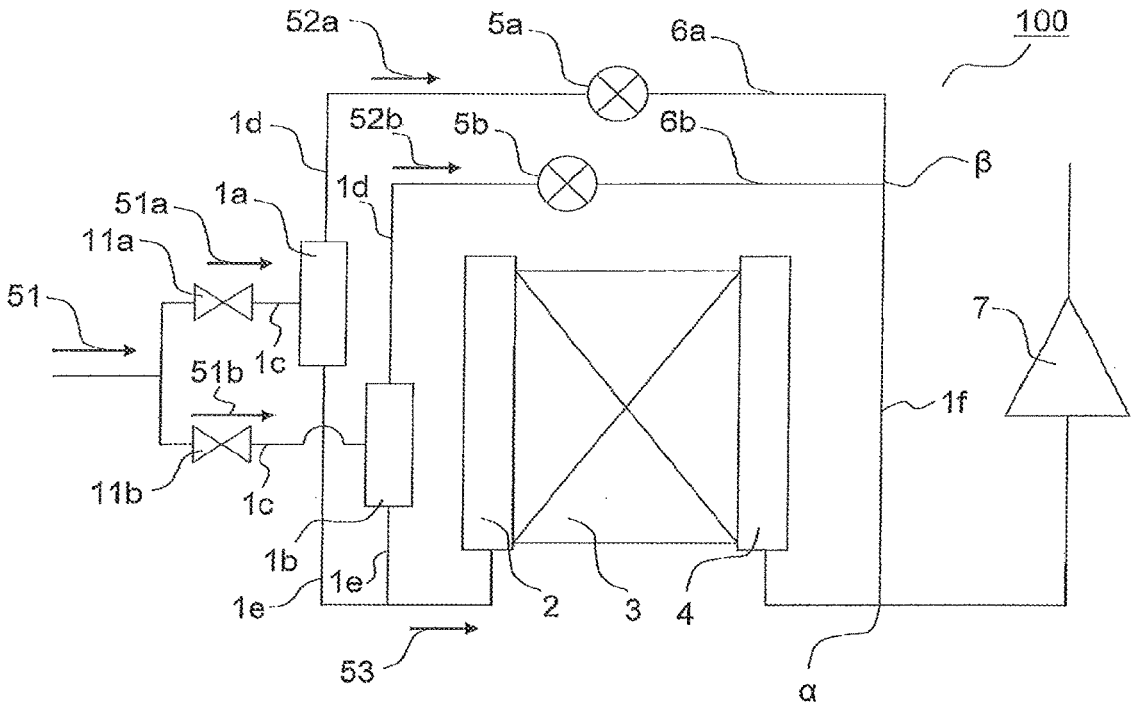
FIG. 1 is a refrigerant circuit diagram of a distribution system according to Embodiment 1 of the present invention.
Figure 2:
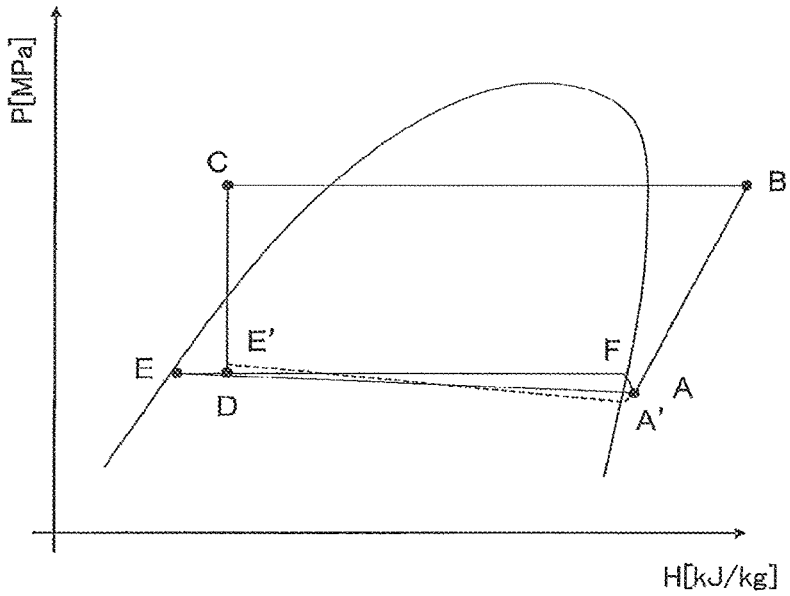
FIG. 2 is a Mollier chart of the distribution system according to Embodiment 1 of the present invention.

FIG. 1 is a refrigerant circuit diagram of a distribution system 100 according to Embodiment 1 of the present invention and FIG. 2 is a Mollier chart of the distribution system 100 according to Embodiment 1 of the present invention. Note that the symbols subscripted with a and b in FIG. 1 denote elements along routes passing through a gas/liquid separator 1*a* and gas/liquid separator 1*b*, respectively. This also applies to FIGS. 3 to 7 described later.

The distribution system 100 according to Embodiment 1 of the present invention separates a two-phase gas-liquid refrigerant 51 into refrigerant vapor 52 and refrigerant liquid 53 using gas/liquid separators 1 (1*a* and 1*b*), causes the refrigerant liquid 53 (or two-phase gas-liquid refrigerant 51) to flow into an evaporating heat exchanger 3, and then causes the refrigerant vapor 52 and refrigerant to merge on a downstream side of the evaporating heat exchanger 3, where the refrigerant has been turned into a gas-phase state by the evaporating heat exchanger 3.

An air-conditioning apparatus is connected by pipes with a compressor 7 and the evaporating heat exchanger 3 as well as with a condensing heat exchanger and an expansion valve (not illustrated) and provided with a refrigerant circuit adapted to circulate the refrigerant.

The distribution system 100 includes the gas/liquid separators 1 (1*a* and 1*b*) making up part of the refrigerant circuit of the air-conditioning apparatus and adapted to separate the incoming two-phase gas-liquid refrigerant 51 into the refrigerant vapor 52 and refrigerant liquid 53, channel switching valves 11 (11*a* and 11*b*) adapted to switch channels leading to the gas/liquid separators 1 (1*a* and 1*b*), by opening and closing, the evaporating heat exchanger 3 adapted to accept inflow of the refrigerant liquid 53 (or two-phase gas-liquid refrigerant), a header 2 installed on an inflow side of the evaporating heat exchanger 3 perpendicularly or at angles to the evaporating heat exchanger 3, a converging unit 4 installed on an outflow side of the evaporating heat exchanger 3, bypass routes 6 (6*a* and 6*b*) adapted to bypass the refrigerant vapor 52 downstream of the evaporating heat exchanger 3 from the gas/liquid separators 1; and flow control valves 5 (5*a* and 5*b*) installed on the bypass routes 6 and adapted to adjust flow rates of the refrigerant vapor 52 by opening and closing.

The gas/liquid separators 1 (1*a* and 1*b*), which are designed to separate the two-phase gas-liquid refrigerant 51 into the refrigerant vapor 52 and refrigerant liquid 53, are connected to first ends of inlet pipes 1*c* connected at a second end to an external circuit and adapted to accept inflow of the two-phase gas-liquid refrigerant 51, gas-side outflow pipes 1*d* connected at a second end to the bypass routes 6 and adapted to allow passage of the refrigerant vapor 52, and liquid-side outlet pipes 1*e* connected at a second end to the header 2 on an inflow side (upstream side) of the evaporating heat exchanger 3 and adapted to allow passage of the refrigerant liquid 53 (or the two-phase gas-liquid refrigerant). Note that gas/liquid separation efficiency of the gas/liquid separators 1 varies with flow rates of incoming refrigerant. Also, it is assumed that shape and size of the gas/liquid separators 1 are not called into question and that the channel switching valves 11 are solenoid valves switchable between open and closed states by an electrical signal.

The evaporating heat exchanger 3 is an air heat exchanger adapted to exchange heat between refrigerant and air and designed such that the low-pressure refrigerant liquid 53 (or two-phase gas-liquid refrigerant 51) flows in, exchanges heat with air, and causes the refrigerant to evaporate. A ramiform heat exchanger pipe on the inflow side of the evaporating heat exchanger 3 is connected to one end of the header 2, which is a flow divider, and the outflow side is connected to one end of the converging unit 4.

Now, in attempting to improve the heat exchanger pipe of evaporating heat exchanger 3 in performance, a heat exchanger pipe such as an internally grooved tube, flat tube, or thin tube is used, but because pressure losses increase at the same time, a multi-branch (ramiform) architecture is used. Therefore, with other than a relatively simple structure such as the header 2 according to Embodiment 1, it is difficult to connect to the ramiform heat exchanger pipe of evaporating heat exchanger 3.

Each bypass route 6, through which the refrigerant vapor 52 resulting from gas/liquid separation passes, is made up of the flow regulating valve 5 adapted to adjust the flow rate of the refrigerant on the bypass route 6 and a pipe. One end of the bypass route 6 is connected to the gas-side outflow pipe 1*d* and the other end is connected to an evaporating heat exchanger downstream-side pipe if at a second meeting point β. Flows of the refrigerant vapor 52 passing through the respective bypass routes 6 merge at the second meeting point β. Also, the refrigerant passing through the evaporating heat exchanger 3 evaporates, turns into a gas-phase state, and merges with the refrigerant vapor 52 at a first meeting point α between the evaporating heat exchanger 3 and compressor 7, where flows of the refrigerant vapor 52 have met each other at the second meeting point β.

Note that an electronic expansion valve or solenoid valve is used as the flow regulating valve 5. When a solenoid valve is used as the flow regulating valve 5, it is necessary to adjust the flow rate of the refrigerant vapor 52 in advance by installing a capillary tube which provides flow resistance on the bypass route 6.

Next, operation of the distribution system 100 will be described with reference to FIGS. 1 and 2 by taking as an example operation of the distribution system 100 during heating operation because the air-conditioning apparatus performs heating operation when the evaporating heat exchanger 3 is used as a heat exchanger in an outdoor unit.

When the gas/liquid separators 1 do not function (do not perform gas/liquid separation), the channel switching valves 11 installed upstream of the gas/liquid separators 1 are fully opened and the flow regulating valves 5 on the bypass routes 6 are fully closed, causing the refrigerant vapor 52 to stop flowing through the bypass routes 6. Therefore, the refrigerant passes through the inlet pipes 1*c* in a two-phase gas-liquid state (point E' in FIG. 2) of the refrigerant vapor 52 and refrigerant liquid 53, and all the refrigerant passes through the liquid-side outlet pipes 1*e* and flows into evaporating heat exchanger 3. Then, the refrigerant passing through the evaporating heat exchanger 3 evaporates, turns into a gas-phase state and flows into a suction side of the compressor 7 (point A' in FIG. 2). Subsequently, the refrigerant is compressed by the compressor 7 and flows out to the side of an indoor unit as high-temperature, high-pressure discharge refrigerant (point B in FIG. 2).

On the other hand, when the gas/liquid separators 1 function (perform gas/liquid separation), the channel switching valves 11 installed upstream of the gas/liquid separators 1 are fully opened and the flow regulating valves 5 on the bypass routes 6 are (fully) opened. Consequently, the refrigerant flows into the inlet pipes 1*c* in a two-phase gas-liquid state (point D in FIG. 2) of the refrigerant vapor 52 and refrigerant liquid 53, and undergoes gas/liquid separation in the gas/liquid separators 1. Flows of the refrigerant vapor 52 resulting from the gas/liquid separation pass through the gas-side outflow pipes 1*d*, flow into the bypass routes 6, pass through the flow regulating valves 5, and then merge at the second meeting point β (point F in FIG. 2).

On the other hand, since part of the refrigerant vapor 52 is bypassed, quality (or void fraction) of the refrigerant liquid 53 (or two-phase gas-liquid refrigerant 51) resulting from gas/liquid separation deteriorates (point E in FIG. 2). The refrigerant liquid 53 flows into the header 2 with deteriorated quality (or void fraction) and then into the evaporating heat exchanger 3. Then, the refrigerant evaporated by the evaporating heat exchanger 3 and turned into a gas-phase state merges with the bypassed refrigerant vapor 52 at the first meeting point α and flows into a suction side of the compressor 7 (point A in FIG. 2). Subsequently, the refrigerant is compressed by the compressor 7 and flows out to the side of the indoor unit as high-temperature, high-pressure discharge refrigerant (B point in FIG. 2).

In so doing, if the quality (or void fraction) at an inlet to the header 2 is reduced, reduction in a flow rate of the gas flowing into the evaporating heat exchanger 3 provides the effect of reducing pressure losses of the evaporating heat exchanger 3, improving refrigerant distribution characteristics in the header 2 and allowing the evaporating heat exchanger 3 to exchange heat in a balanced manner.

In this way, when the refrigerant passing through the gas/liquid separators 1 is at a rated condition (high flow rate condition), if the channel switching valves 11*a* and 11*b* are both fully open and the gas/liquid separators 1*a* and 1*b* are both used, much refrigerant vapor 52 can be produced by gas/liquid separation and caused to flow out to the bypass routes 6, allowing the quality (or void fraction) at the inlet to the header 2 to be adjusted to a low level, and thereby improving the distribution characteristics in the header 2. This is because, under the rated condition (high flow rate condition), as the refrigerant flow rate is high after all, even the refrigerant liquid 53 alone can make a flow pattern uniform in the header 2, allowing the refrigerant liquid 53 to flow into as far as an upper space of the header 2. Therefore, it is advisable to reduce the refrigerant vapor 52 unnecessary for heat exchange.

Figure 3:
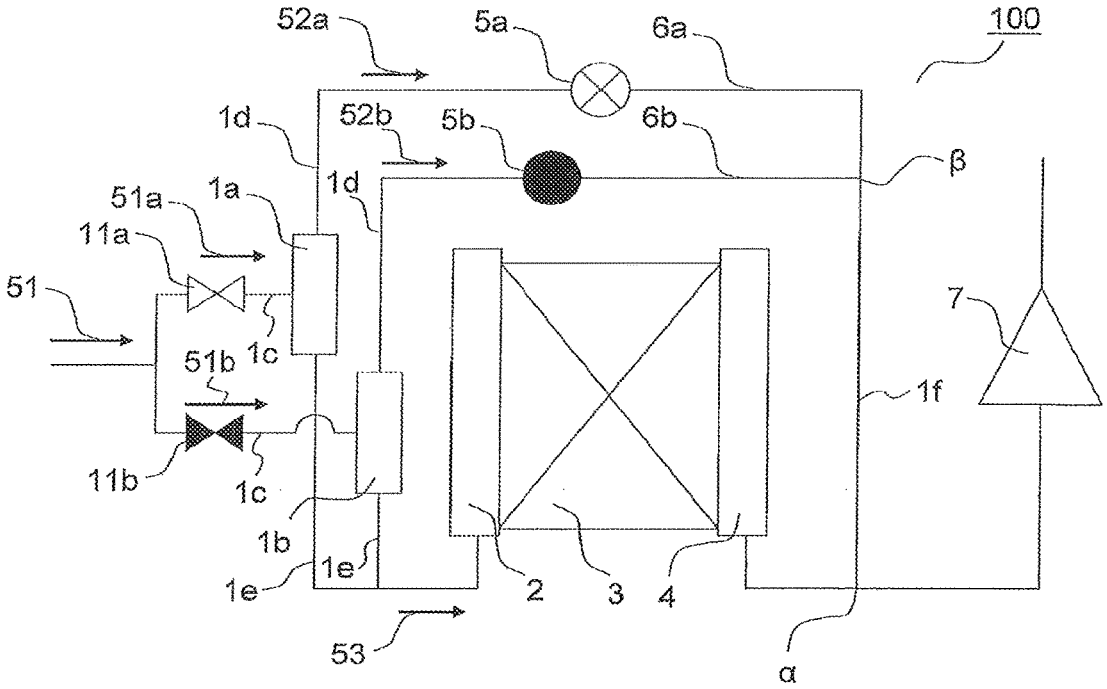
FIG. 3 is a circuit diagram of the distribution system according to Embodiment 1 of the present invention under a low flow rate condition.

FIG. 3 is a circuit diagram of the distribution system 100 according to Embodiment 1 of the present invention under a low flow rate condition.

Note that the black marks in FIG. 3 indicate a fully closed state, and the channel switching valve 11*b* and flow regulating valve 5*b* are in a fully closed state.

On the other hand, in the case of an intermediate condition (low flow rate condition) or other similar condition, in which the flow rate is lower than in the rated condition, the channel switching valve 11*b* is fully closed as illustrated in FIG. 3 for optimum gas/liquid separation (to improve gas/liquid separation efficiency). Then, it becomes necessary to keep the refrigerant from flowing into the gas/liquid separator 1*b*, adjust (increase) an amount of refrigerant flowing into the gas/liquid separator 1*a*, and adjust the refrigerant vapor 52 to be bypassed. Consequently, a larger amount of refrigerant vapor 52 is produced by gas/liquid separation and caused to flow out to the bypass routes 6, reducing the quality (or void fraction) at the inlet to the header 2. This allows the refrigerant liquid 53 to reach upper space of the header 2, making it possible to improve the distribution characteristics.

That is, if the refrigerant flow rates in the gas/liquid separators 1*a* and 1*b* exceed a proper range, the gas/liquid separation efficiency of the gas/liquid separators 1*a* and 1*b* falls. Therefore, if (an upper limit of) the proper range of the refrigerant flow rates is about to be exceeded under the rated condition (high flow rate condition), the gas/liquid separators 1*a* and 1*b* are both used and the refrigerant flow rates in the gas/liquid separators 1*a* and 1*b* are reduced and kept in the proper range, and if (a lower limit) the proper range of the refrigerant flow rates is about to be exceeded under the intermediate condition (low flow rate condition), only the gas/liquid separator 1*a* is used and the refrigerant flow rate in the gas/liquid separator 1*a* is increased and kept in the proper range, thereby adjusting the quality (or void fraction) at the inlet to the header 2 and improving the distribution characteristics.

As described above, the channel switching valves 11 are opened and closed according to the flow rate of the refrigerant flowing through the refrigerant circuit of the air-conditioning apparatus (flowing into the distribution system 100), thereby changing the number of gas/liquid separators 1 into which the refrigerant flows, thereby adjusting the flow rates of the refrigerant flowing into the gas/liquid separators 1 to ensure that optimum gas/liquid separation can be achieved. Since this allows the quality (or void fraction) at the inlet to the header 2 to be adjusted to a low level, stable distribution characteristics can be obtained in a wide flow rate range in the header 2, making it possible to reduce pressure losses at an inlet to the evaporating heat exchanger 3. Also, because a structure of the header 2 is not changed, increases in costs can be curbed.

Note that although in Embodiment 1, the evaporating heat exchanger 3 is used as an outdoor heat exchanger during heating operation, the evaporating heat exchanger 3 can also be used as an outdoor heat exchanger during cooling operation. Also, the evaporating heat exchanger 3 is applicable not only to a system containing one indoor unit for one outdoor unit, but also to a system containing plural indoor units for one outdoor unit or a system containing plural outdoor units. This also applies to Embodiments 2 to 4 described below. Also, the refrigerant used in the present distribution system is not particularly limited but, for example, when a mildly flammable refrigerant (R32 refrigerant, HFO refrigerant, or a mixture thereof) or a flammable refrigerant (propane, isobutane, dimethyl ether, ammonia, or a mixture thereof) is used as a refrigerant, by using plural gas/liquid separators, volume per gas/liquid separator can be reduced, making it possible to diversify the risk of flammability.

Embodiment 2

Figure 4:
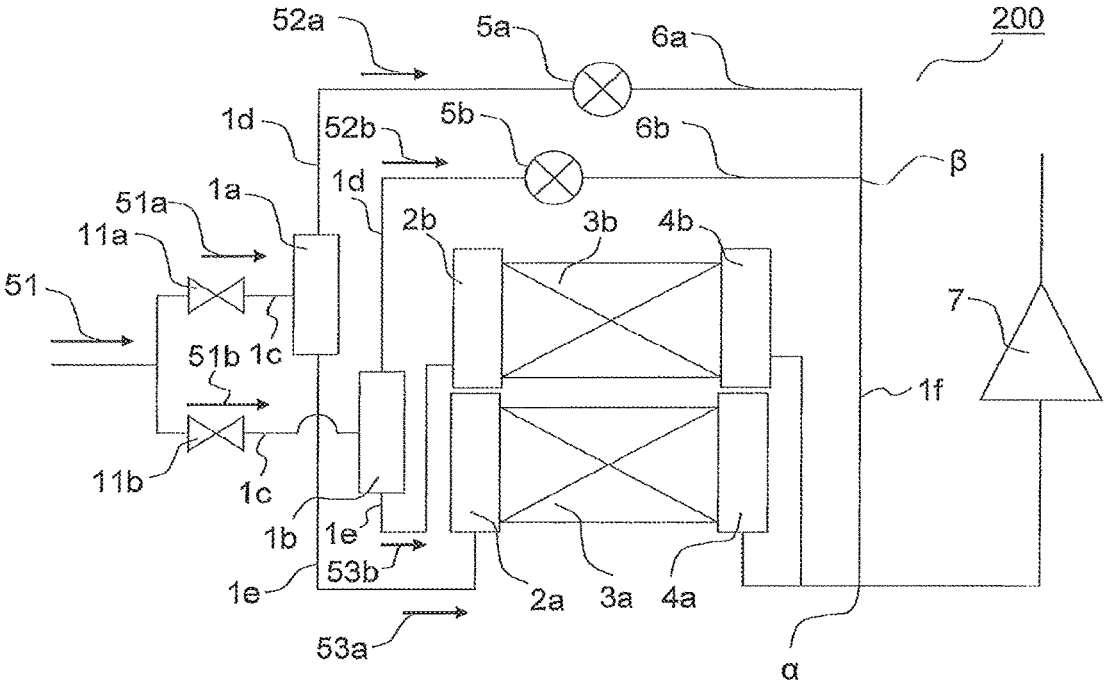
FIG. 4 is a refrigerant circuit diagram of a distribution system according to Embodiment 2 of the present invention.
Figure 5:
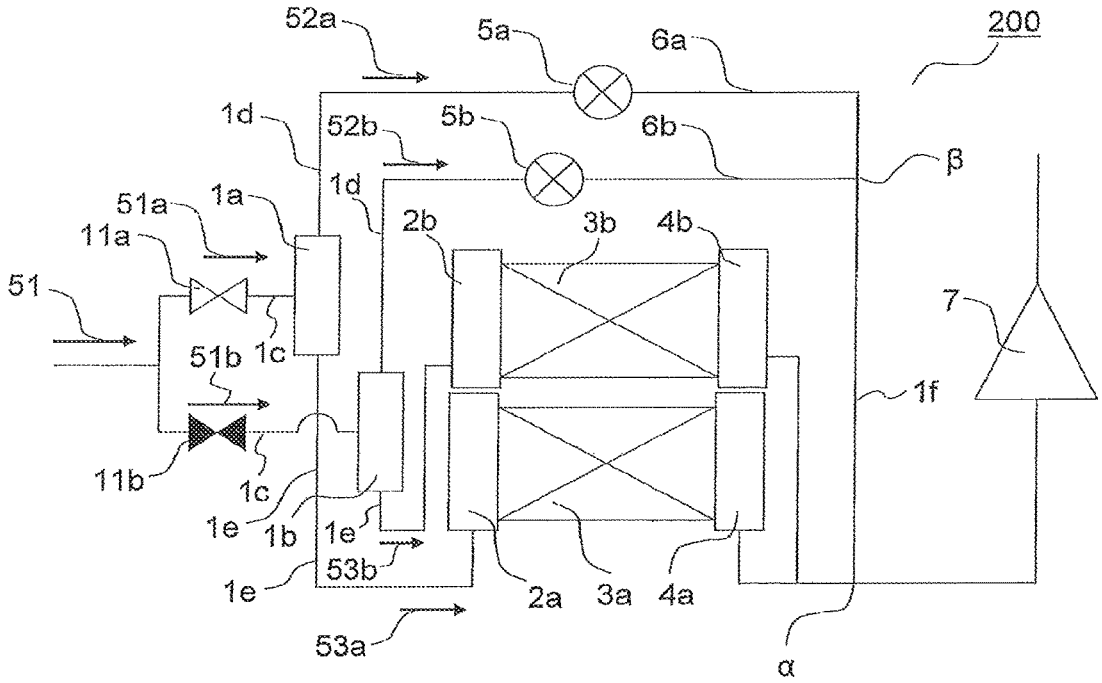
FIG. 5 is a circuit diagram of the distribution system according to Embodiment 2 of the present invention under a low flow rate condition.

FIG. 4 is a refrigerant circuit diagram of a distribution system 200 according to Embodiment 2 of the present invention and FIG. 5 is a circuit diagram of the distribution system 200 according to Embodiment 2 of the present invention under a low flow rate condition.

Embodiment 2 of the present invention will be described below, but description in common with Embodiment 1 will be omitted.

The distribution system 200 according to Embodiment 2 differs from the distribution system 100 in that the evaporating heat exchanger 3 is divided into two units, equal in number to the gas/liquid separators 1. One end of an evaporating heat exchanger 3*a* is connected to a header 2*a* connected to the gas/liquid separator 1*a* while one end of an evaporating heat exchanger 3*b* is connected to a header 2*b* connected to the gas/liquid separator 1*b*.

Also, the other end of the evaporating heat exchanger 3*a* is connected to one end of a converging unit 4*a* and the other end of the evaporating heat exchanger 3*b* is connected to one end of a converging unit 4*b* while the other ends of the converging unit 4*a* and converging unit 4*b* are connected to one end of the evaporating heat exchanger downstream-side pipe 1*f*. The other end of the evaporating heat exchanger downstream-side pipe 1*f* is connected to the gas-side outflow pipe 1*d*, causing flows of refrigerant to merge with each other after passage through the converging unit 4*a* or converging unit 4*b* as well as to join the bypass routes 6.

With the above configuration, in a low flow rate condition such as the intermediate condition, if the refrigerant is kept from flowing into the gas/liquid separator 1*b* by fully closing the channel switching valve 11*b* as illustrated in FIG. 5, the refrigerant stops flowing to the header 2*b* and the evaporating heat exchanger 3*b* as well. Consequently, all the refrigerant passes through the gas/liquid separator 1*a*, and after gas/liquid separation, refrigerant vapor 52*a* passes through the bypass route 6*a* while refrigerant liquid 53*a* passes through the header 2*a* and evaporating heat exchanger 3*a*, thereby being evaporated, merges with the bypassed refrigerant vapor 52*a* and flows out to the compressor 7.

Here, heat transfer performance of the evaporating heat exchanger 3 is proportional to flow velocity of the refrigerant flowing through the evaporating heat exchanger 3, and the lower the refrigerant flow velocity, the lower the heat transfer performance. Also, the flow velocity decreases with decreases in the flow rate of the refrigerant flowing through a unit volume of the evaporating heat exchanger 3.

Thus, with the configuration of Embodiment 2, after gas/liquid separation of all the refrigerant under the low flow rate condition, since the refrigerant flows into the post-division evaporating heat exchanger 3*a*, the refrigerant flow velocity of the refrigerant flowing through a unit volume of the evaporating heat exchanger 3*a* can be kept at slightly higher level than the undivided evaporating heat exchanger 3 such as that of Embodiment 1. Consequently, distribution performance can be improved without compromising the heat transfer performance, making it possible to exchange heat more efficiently. Also, in the case of an outdoor unit having two fans, if the fan is operated only in one of the post-division evaporating heat exchangers 3*a* and 3*b*, whichever the refrigerant flows through, a refrigeration cycle with higher energy effectiveness can be achieved.

Embodiment 3

Figure 6:
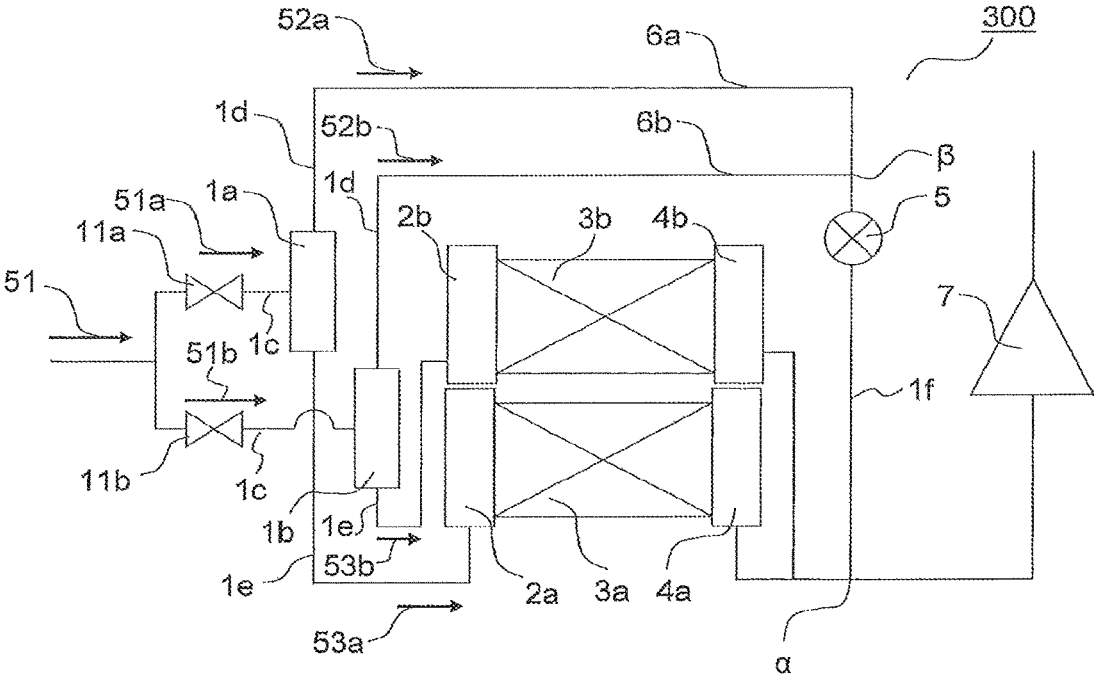
FIG. 6 is a circuit diagram of a distribution system according to Embodiment 3 of the present invention under a low flow rate condition.

FIG. 6 is a circuit diagram of a distribution system 300 according to Embodiment 3 of the present invention under a low flow rate condition.

Embodiment 3 of the present invention will be described below, but description in common with Embodiments 1 and 2 will be omitted.

As with Embodiment 2, description will be given by taking as an example a circuit using a system in which the evaporating heat exchanger 3 is divided.

The distribution system 300 is characterized in that a flow regulating valve 5 is installed on the evaporating heat exchanger downstream-side pipe if after the bypass routes 6 merge with each other rather than on the bypass routes 6*a* and 6*b*. Note that the rest of the circuit configuration is the same as that of the distribution system 200.

The above configuration is effective in production and costs because the number of flow regulating valves 5 (two in Embodiments 1 and 2), which are as many as the gas/liquid separators 1, can be reduced to one.

Embodiment 4

Figure 7:
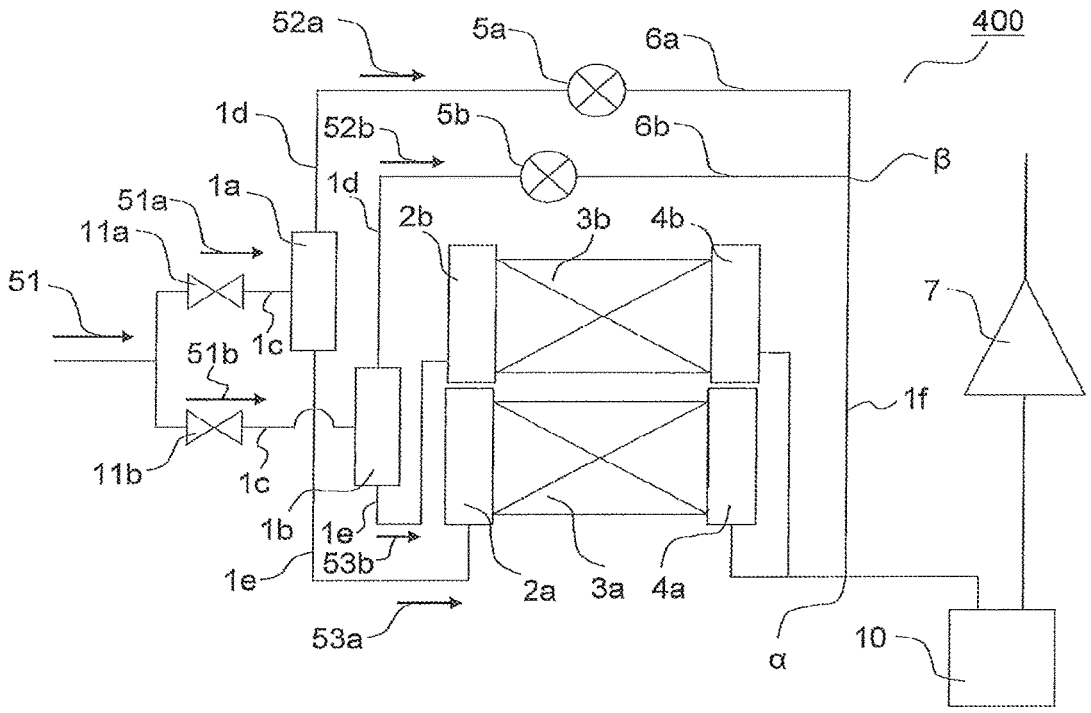
FIG. 7 is a circuit diagram of a distribution system according to Embodiment 4 of the present invention under a low flow rate condition.

FIG. 7 is a circuit diagram of a distribution system 400 according to Embodiment 4 of the present invention under a low flow rate condition.

Embodiment 4 of the present invention will be described below, but description in common with Embodiments 1 to 3 will be omitted.

The distribution system 400 is characterized by including an accumulator 10 adapted to accumulate surplus refrigerant, which is installed between the first meeting point α and compressor 7 or at the same location as the first meeting point α. Note that the rest of the circuit configuration is the same as that of the distribution system 200.

With the above configuration, even if the refrigerant liquid 53 flows out into the bypass routes 6 due to a control failure of the flow regulating valves 5, since the refrigerant liquid 53 can be accumulated in the accumulator 10, the refrigerant liquid 53 is not returned to the compressor 7 and failure of the compressor 7 can be prevented. Also, resistance of the evaporating heat exchanger 3 as well as a four-way valve and other valves (not illustrated) installed along a route from the gas/liquid separator (quality adjustment device) 1 to the accumulator 10 provides a bypass route for the refrigerant vapor 52, making it possible to reduce pressure losses in the entire refrigeration cycle. Furthermore, when, for example, a refrigerant such as an R32 refrigerant that increases a discharge temperature of the compressor 7 is used, some of plural gas/liquid separator circuits can be used for liquid injection, making it possible to reduce increases in the discharge temperature of the compressor 7 by returning the refrigerant liquid 53 to the accumulator 10. When liquid is injected, for example, the refrigerant vapor 52*a* can be used for liquid injection by increasing an opening degree of the flow regulating valve 5*a*.

Embodiment 5

Figure 8:
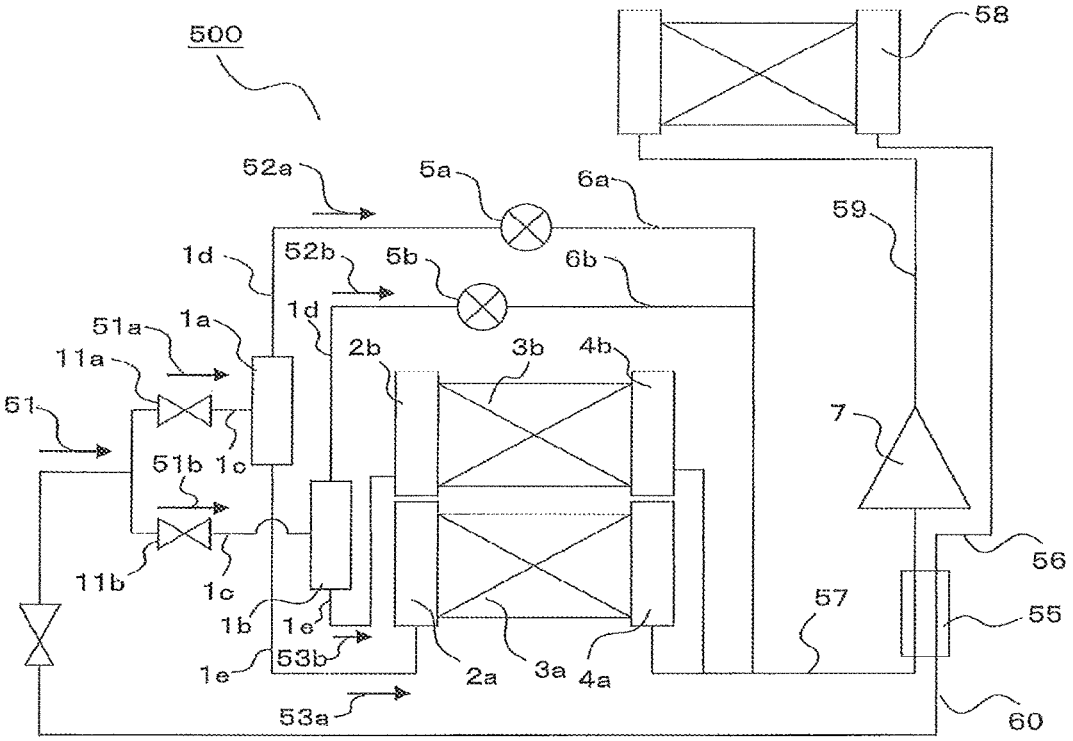
FIG. 8 is a circuit diagram of a distribution system according to Embodiment 5 of the present invention under a low flow rate condition.

FIG. 8 is a circuit diagram of a distribution system 500 according to Embodiment 5 of the present invention.

Embodiment 5 of the present invention will be described below, but description in common with Embodiments 1 to 4 will be omitted.

The distribution system 500 is characterized by including an internal heat exchanger 55 adapted to exchange heat between the refrigerant flowing through an outdoor unit outlet pipe 57 and refrigerant flowing through an indoor unit outlet pipe 56.

An indoor unit (condensing heat exchanger) 58 is installed downstream of the compressor 7 and connected with a compressor discharge pipe 59 and the indoor unit outlet pipe 56, where the compressor discharge pipe 59 is connected to the compressor 7 while the indoor unit outlet pipe 56 is connected to the internal heat exchanger 55. Also, the internal heat exchanger 55 is connected with an upstream side of the channel switching valves 11 via an internal heat exchanger outlet pipe 60. Note that the rest of the circuit configuration is the same as that of the distribution system 200.

In the internal heat exchanger 55, which is designed to exchange heat between the refrigerant vapor after merging at the first meeting point α and the refrigerant liquid flowing out of the indoor unit 58, the refrigerant vapor absorbs heat and the refrigerant liquid rejects heat. After the heat exchange, the refrigerant vapor flows into the suction side of the compressor 7 while the refrigerant liquid merges with the two-phase gas-liquid refrigerant 51 on the upstream side of the channel switching valves 11.

With the above configuration, should the refrigerant liquid 53 flow out into the bypass routes 6 due to a control failure of the flow regulating valves 5, the refrigerant liquid 53 can be vaporized by the internal heat exchanger 55. Consequently, the refrigerant liquid 53 is not returned to the compressor 7 and failure of the compressor 7 can be prevented.

Also, resistance of the evaporating heat exchanger 3 as well as a four-way valve and other valves (not illustrated) installed along a route from the gas/liquid separator (quality adjustment device) 1 to the internal heat exchanger 55 provides a bypass route for the refrigerant vapor 52, making it possible to reduce pressure losses in the entire refrigeration cycle. Also, the use of the internal heat exchanger 55 reduces an amount of refrigerant gas flowing into the gas/liquid separator (quality adjustment device) 1, making it possible to downsize the gas/liquid separator 1 accordingly. Besides, since the refrigerant liquid 53 flowing through the outdoor unit outlet pipe 57 is vaporized by the internal heat exchanger 55, input work necessary for the compressor 7 can be reduced, making it possible to improve system performance.

REFERENCE SIGNS LIST

1 gas/liquid separator 1*c* inlet pipe 1*d* gas-side outflow pipe 1*e* liquid-side outlet pipe 1*f* evaporating heat exchanger downstream-side pipe 2 header 3 evaporating heat exchanger 4 converging unit 5 flow regulating valve 6 bypass route 7 compressor 10 accumulator 11 channel switching valve 51 two-phase gas-liquid refrigerant 52 refrigerant vapor 53 refrigerant liquid 55 internal heat exchanger 56 indoor unit outlet pipe 57 outdoor unit outlet pipe 58 indoor unit 59 compressor discharge pipe 60 internal heat exchanger outlet pipe 100 distribution system (using plural gas/liquid separators) 200 distribution system (with divided evaporating heat exchanger) 300 distribution system (with unified flow regulating valves) 400 distribution system (equipped with accumulator) 500 distribution system (equipped with internal heat exchanger) α first meeting point β second meeting point

The invention claimed is:

1. A refrigerant circuit comprising:

a plurality of gas/liquid separators configured to separate two-phase gas-liquid refrigerant into refrigerant vapor and refrigerant liquid in a first mode of operation and configured to allow the two-phase gas-liquid refrigerant to flow out of the respective gas/liquid separator without being separated in a second mode of operation, each gas/liquid separator includes an inflow channel configured to receive the two-phase gas-liquid refrigerant;

a plurality of channel switching valves, each channel switching valve is connected to a respective upstream side of gas/liquid separators and configured to switch delivery of the two-phase gas-liquid refrigerant between said inflow channels for the two-phase gas-liquid refrigerant by opening and closing;

an evaporating heat exchanger comprising at least one heat exchanger configured to accept inflow of the refrigerant liquid or the two-phase gas-liquid refrigerant from the plurality of gas/liquid separators;

a header installed on an upstream side of each of the at least one evaporating heat exchanger perpendicularly or at angles to the evaporating heat exchanger;

wherein each of the plurality of gas/liquid separators further comprises a liquid-side outlet pipe connecting the respective gas/liquid separators to the header, the liquid-side outlet pipes allowing passage of the refrigerant liquid or the two-phase gas-liquid refrigerant from the gas/liquid separators to the header;

a compressor installed on a downstream side of the evaporating heat exchanger; and a plurality of bypass routes, each bypass route is connected to a respective one of the gas/liquid separators and configured to allow passage of the refrigerant vapor, wherein the refrigerant vapor passing through the plurality of bypass routes and refrigerant vapor exiting the evaporating heat exchanger merge at a first meeting point between the evaporating heat exchanger and the compressor, and wherein the pressure of the refrigerant flowing into the gas-liquid separator is closer to the pressure of the refrigerant sucked by the compressor than the pressure of the refrigerant discharged by the compressor, and the pressure of the refrigerant at an inlet of the header is the same as the pressure of the refrigerant at an outlet of the gas/liquid separators.

2. The refrigerant circuit of claim 1, wherein one of mildly flammable refrigerant and flammable refrigerant is used as refrigerant circulating in the circuit.

3. The refrigerant circuit of claim 1, wherein a flow regulating valve configured to regulate a flow rate of the refrigerant vapor is installed on each of the bypass routes.

4. The refrigerant circuit of claim 1, wherein, the evaporating heat exchanger comprises a plurality of the evaporating heat exchangers, a number of evaporating heat exchangers equals a number of gas/liquid separators, and each of the gas/liquid separators is connected to a respective header.

5. The refrigerant circuit of claim 1, further comprising an accumulator configured to accumulate surplus refrigerant, wherein the accumulator is installed between the first meeting point and the compressor or at a same location as the first meeting point.

6. The refrigerant circuit of claim 1, further comprising an internal heat exchanger and a condensing heat exchanger, wherein, the internal heat exchanger is installed between the first meeting point and the compressor or at a same location as the first meeting point, the condensing heat exchanger is installed on a downstream side of the compressor, and the internal heat exchanger exchanges heat between the refrigerant vapor after merging at the first meeting point and the refrigerant liquid flowing out of the condensing heat exchanger.

7. The refrigerant circuit of claim 1, wherein, the plurality of gas/liquid separators are configured to be selectively opened and closed by opening and closing the channel switching valve according to a refrigerant flow rate.

8. An air-conditioning apparatus equipped with the refrigerant circuit of claim 1.

9. The refrigerant circuit of claim 1, wherein the channel switching valves are configured to open and close to thereby change the number of gas/liquid separators performing separation.

10. The refrigerant circuit of claim 9, wherein the number of the gas/liquid separators performing separation is changed based on a flow rate of refrigerant to be separated.

11. The refrigerant circuit of claim 1, wherein the plurality of bypass routes merge at a second meeting point on an upstream side of the first meeting point, the flow regulating valve is installed on an upstream side of the second meeting point, and the second meeting point is connected to the first meeting point by a single pipe line.

* * * * *